US008371339B2

(12) United States Patent
Li et al.

(10) Patent No.: US 8,371,339 B2
(45) Date of Patent: Feb. 12, 2013

(54) FABRIC STRUCTURE

(75) Inventors: Chen-Liang Li, Taipei County (TW); Kuo-Hsiang Wang, Taipei (TW)

(73) Assignee: Taiwan Textile Research Institute, New Taipei (TW)

( * ) Notice: Subject to any disclaimer, the term of this patent is extended or adjusted under 35 U.S.C. 154(b) by 37 days.

(21) Appl. No.: 12/948,781

(22) Filed: Nov. 18, 2010

(65) Prior Publication Data

US 2011/0061842 A1 Mar. 17, 2011

Related U.S. Application Data

(63) Continuation-in-part of application No. 12/345,594, filed on Dec. 29, 2008, now abandoned.

(30) Foreign Application Priority Data

Dec. 19, 2008 (TW) ..... 97149763 A

(51) Int. Cl.

| | |
|---|---|
| ***D03D 13/00*** | (2006.01) |
| ***D03D 15/00*** | (2006.01) |
| *D03D 1/00* | (2006.01) |
| *D03D 25/00* | (2006.01) |

(52) U.S. Cl. ..... 139/420 R; 139/383 R; 139/415; 139/425 R; 139/426 R; 139/420 A

(58) Field of Classification Search ..... 139/383 R, 139/408–415, 420 R, 425 R, 426 R, 420 A, 139/DIG. 1

See application file for complete search history.

(56) References Cited

U.S. PATENT DOCUMENTS

| | | | | |
|---|---|---|---|---|
| 2,274,840 | A * | 3/1942 | Marick et al. | 338/208 |
| 3,197,555 | A * | 7/1965 | Mittler | 174/268 |
| 4,173,131 | A * | 11/1979 | Pendergrass et al. | 602/76 |
| 4,500,593 | A * | 2/1985 | Weber | 442/200 |
| 4,654,748 | A * | 3/1987 | Rees | 361/220 |
| 4,664,158 | A * | 5/1987 | Sands | 139/422 |
| 4,813,459 | A * | 3/1989 | Breidegam | 139/421 |
| 4,853,269 | A * | 8/1989 | Fukumori et al. | 428/43 |
| 5,021,283 | A * | 6/1991 | Takenaka et al. | 428/116 |
| 5,387,455 | A * | 2/1995 | Horsch | 428/116 |
| 5,593,941 | A * | 1/1997 | Kato et al. | 503/227 |
| 5,759,207 | A * | 6/1998 | Green | 8/115.7 |
| 6,668,868 | B2 * | 12/2003 | Howland et al. | 139/383 R |
| 6,924,244 | B2 * | 8/2005 | Takagi et al. | 442/181 |
| 2002/0124904 | A1 * | 9/2002 | Howland et al. | 139/420 R |
| 2003/0054719 | A1 * | 3/2003 | Takagi et al. | 442/190 |
| 2005/0271821 | A1 * | 12/2005 | Lee et al. | 427/355 |

(Continued)

FOREIGN PATENT DOCUMENTS

| | | |
|---|---|---|
| JP | S61-27085 | 2/1986 |
| JP | H07-256804 | 10/1995 |

OTHER PUBLICATIONS

Merriam Webster's dictionary, "interlace".*

(Continued)

*Primary Examiner* — Bobby Muromoto, Jr.
(74) *Attorney, Agent, or Firm* — Jianq Chyun IP Office

(57) ABSTRACT

A fabric structure includes a first fabric layer, a second fabric layer, a plurality of conductive yarns, and a plurality of connecting yarns. A yarn coverage ratio of the first fabric layer ranges from about 90% to about 100%. A yarn coverage ratio of the second fabric layer ranges from about 90% to about 100%. The conductive yarns are distributed between the first fabric layer and the second fabric layer. The connecting yarns interlace the first fabric layer and the second fabric layer, so that the conductive yarns are sandwiched between the first fabric layer and the second fabric layer. The conductive yarns and the connecting yarns are not interlaced.

19 Claims, 7 Drawing Sheets

U.S. PATENT DOCUMENTS

2006/0144575 A1* 7/2006 Chu et al. ..... 165/133
2006/0223400 A1* 10/2006 Yasui et al. ..... 442/181
2007/0037020 A1* 2/2007 Blake et al. ..... 428/921
2007/0202763 A1* 8/2007 Shibaoka et al. ..... 442/203
2007/0215232 A1* 9/2007 Hassonjee et al. ..... 139/425 R
2008/0010723 A1* 1/2008 Bingham ..... 2/227
2008/0202623 A1* 8/2008 DeAngelis et al. ..... 139/425 R
2009/0011270 A1* 1/2009 Hsu ..... 428/606
2009/0159149 A1* 6/2009 Karayianni et al. ..... 139/425 R

OTHER PUBLICATIONS

"Office Action of Japan Counterpart Application", issued on Jul. 30, 2012, pp. 1-3, in which the listed references were cited.

* cited by examiner

FABRIC STRUCTURE

CROSS-REFERENCE TO RELATED APPLICATION

This is a continuation-in-part application of patent application Ser. No. 12/345,594, filed on Dec. 29, 2008, which claims the priority benefit of Taiwan application serial no. 97149763, filed on Dec. 19, 2008. The entirety of each of the above-mentioned patent applications is hereby incorporated by reference herein and made a part of this specification.

BACKGROUND OF THE INVENTION

1. Field of the Invention

The invention relates to a fabric structure, and more particularly to a fabric structure having a heating function or a heat-retaining function.

2. Description of Related Art

Under the trend of globalization, the textile industry is facing severe competition, and textile manufacturers have to continue researching and developing new technology and diversified products to keep up with the worldwide competition. In order to satisfy diversified demands from consumers, a plurality of multi-functional fabric products are already available in the market, such as water-proof fabrics, warmth-retentive fabrics, or electrothermal fabrics.

A general electrothermal fabric has a structure including a surface layer, a heating layer, and a heat-insulating layer. A manufacturing process of the electrothermal fabric includes first weaving or knitting the surface layer, the heating layer, and the heat-insulating layer and assembling the surface layer, the heating layer, and the heat-insulating layer by performing a sewing process or an adhering process, such that the heating layer is sandwiched between the surface layer and the heat-insulating layer.

However, the manufacturing method of normal electrothermal fabrics requires one more sewing or adhering process to stack the three layers, and the sewing or adhering process is likely to allow air to exist between every two of the three layers, which results in air layers. The thermal conductivity of air is lower than the thermal conductivity of a normal surface layer, a normal heating layer, or a normal heat-insulating layer, and therefore the air layers reduce the thermal conductivity of the electrothermal fabrics. Moreover, when the surface layer, the heating layer and the heat-insulating layer are sewn together, the air layers distributed between every two of the three layers are likely to be distributed unevenly, such that uniformity of the thermal conductivity is affected, and that the temperature distribution of the electrothermal fabric is also uneven.

SUMMARY OF THE INVENTION

The invention is directed to a fabric structure capable of performing a heating function or a heat-retaining function by changing yarn coverage ratios of fabric layers in the fabric structure.

The invention provides a fabric structure that includes a first fabric layer, a second fabric layer, a plurality of conductive yarns, and a plurality of connecting yarns. A yarn coverage ratio of the first fabric layer ranges from about 90% to about 100%. A yarn coverage ratio of the second fabric layer ranges from about 90% to about 100%. The conductive yarns are distributed between the first fabric layer and the second fabric layer. The connecting yarns interlace the first fabric layer and the second fabric layer, such that the conductive yarns are sandwiched between the first fabric layer and the second fabric layer. The conductive yarns and the connecting yarns are not interlaced.

According to an embodiment of the invention, a total thickness of the first fabric layer, the second fabric layer, and the connecting yarns ranges from about 3 millimeters to about 20 millimeters.

According to an embodiment of the invention, a characteristic thermal insulation value (CLO) of the fabric structure ranges from about 0.1 to about 0.15.

According to an embodiment of the invention, the first fabric layer and the second fabric layer are heat transfer fabric layers.

According to an embodiment of the invention, the yarn coverage ratio of the first fabric layer is different from the yarn coverage ratio of the second fabric layer.

According to an embodiment of the invention, the yarn coverage ratio of the first fabric layer is substantially the same as the yarn coverage ratio of the second fabric layer.

According to an embodiment of the invention, the first fabric layer, the second fabric layer, and the connecting yarns are integrally woven or knitted.

The invention also provides a fabric structure that includes a first fabric layer, a second fabric layer, a plurality of conductive yarns, and a plurality of connecting yarns. A yarn coverage ratio of the first fabric layer is less than 80%. A yarn coverage ratio of the second fabric layer ranges from about 90% to about 100%. The conductive yarns are distributed between the first fabric layer and the second fabric layer. The connecting yarns interlace the first fabric layer and the second fabric layer, such that the conductive yarns are sandwiched between the first fabric layer and the second fabric layer. The conductive yarns and the connecting yarns are not interlaced.

According to an embodiment of the invention, a total thickness of the first fabric layer, the second fabric layer, and the connecting yarns ranges from about 3 millimeters to about 20 millimeters.

According to an embodiment of the invention, CLO of the fabric structure ranges from about 0.1 to about 0.15.

According to an embodiment of the invention, the first fabric layer is a heat-insulating fabric layer, and the second fabric layer is a heat transfer fabric layer.

According to an embodiment of the invention, the first fabric layer, the second fabric layer, and the connecting yarns are integrally woven or knitted.

The invention further provides a fabric structure that includes a first fabric layer, a second fabric layer, a plurality of conductive yarns, and a plurality of connecting yarns. A yarn coverage ratio of the first fabric layer is less than 80%. A yarn coverage ratio of the second fabric layer is less than 80%. The conductive yarns are distributed between the first fabric layer and the second fabric layer. The connecting yarns interlace the first fabric layer and the second fabric layer, such that the conductive yarns are sandwiched between the first fabric layer and the second fabric layer. The conductive yarns and the connecting yarns are not interlaced.

According to an embodiment of the invention, a total thickness of the first fabric layer, the second fabric layer, and the connecting yarns ranges from about 3 millimeters to about 20 millimeters.

According to an embodiment of the invention, CLO of the fabric structure ranges from about 0.15 to about 0.25.

According to an embodiment of the invention, the first fabric layer and the second fabric layer are heat-insulating fabric layers.

According to an embodiment of the invention, the yarn coverage ratio of the first fabric layer is different from the yarn coverage ratio of the second fabric layer.

According to an embodiment of the invention, the yarn coverage ratio of the first fabric layer is substantially the same as the yarn coverage ratio of the second fabric layer.

According to an embodiment of the invention, the first fabric layer, the second fabric layer, and the connecting yarns are integrally woven or knitted.

Based on the above, the fabric structure of the invention is capable of performing a heating function or a heat-retaining function by changing the yarn coverage ratio of the first fabric layer and the yarn coverage ratio of the second fabric layer.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
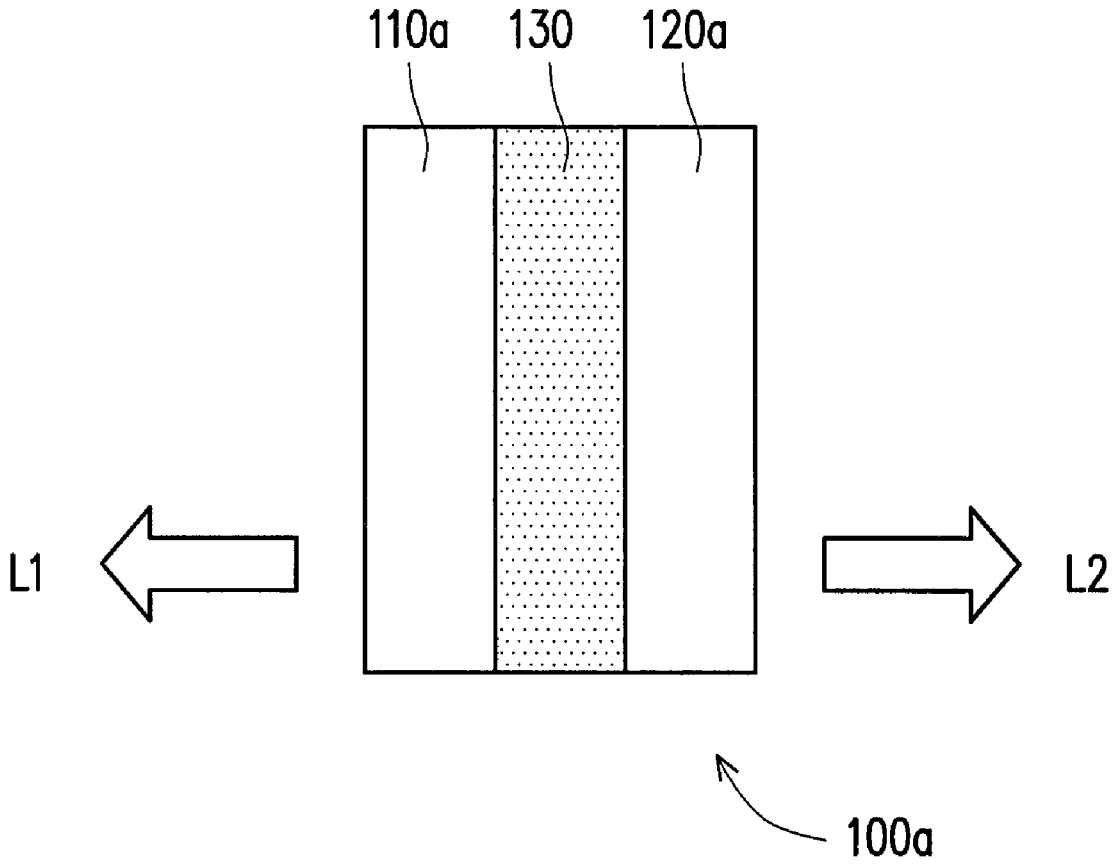
FIG. 1A is a schematic view illustrating a fabric structure according to an embodiment of the invention.
Figure 1B:
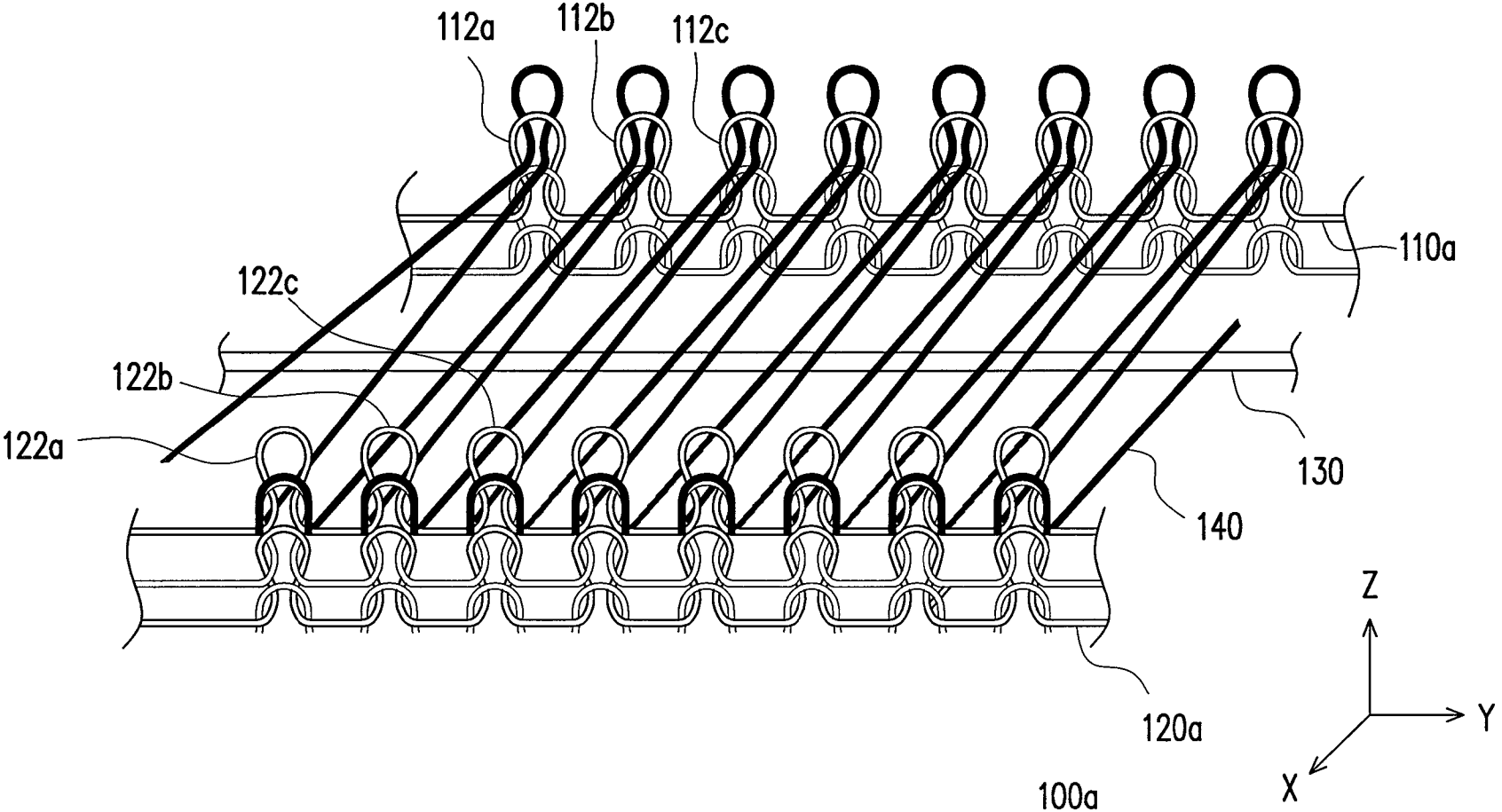
FIG. 1B is a structural view illustrating the fabric structure depicted in FIG. 1A.

FIG. 1A is a schematic view illustrating a fabric structure according to an embodiment of the invention. FIG. 1B is a structural view illustrating the fabric structure depicted in FIG. 1A. With reference to FIG. 1A and FIG. 1B, the fabric structure 100*a* of this embodiment includes a first fabric layer 110*a*, a second fabric layer 120*a*, a plurality of conductive yarns 130, and a plurality of connecting yarns 140. The connecting yarns 140 interlace the first fabric layer 110*a* and the second fabric layer 120*a*, such that the conductive yarns 130 are sandwiched between the first fabric layer 110*a* and the second fabric layer 120*a*. Specifically, the conductive yarns 130 of this embodiment do not interlace the connecting yarns 140, the first fabric layer 110*a*, and the second fabric layer 120*a*. The conductive yarns 130 only pass through the space between the first fabric layer 110*a* and the second fabric layer 120*a*. It should be mentioned that the first fabric layer 110*a* and the second fabric layer 120*a* that are depicted in FIG. 1B are arranged on the X-axis, while the surface of the first fabric layer 110*a* and the surface of the second fabric layer 120*a* are perpendicular to the direction of X-axis. Besides, the surfaces (e.g., on the Y-Z plane shown in FIG. 1B) of the first fabric layer 110*a* and the second fabric layer 120*a* have a plurality of peak loops 112*a*, 112*b*, 112*c*, 122*a*, 122*b*, and 122*c* thereon.

In particular, according to this embodiment, the total thickness of the first fabric layer 110*a*, the second fabric layer 120*a*, and the connecting yarns 140 ranges from about 3 millimeters to about 20 millimeters, for instance. The conductive yarns 130 distributed between the first fabric layer 110*a* and the second fabric layer 120*a* are, for example, flexible metal wires with insulating sheath which are warped because of gravity. When an electric current passes through the conductive yarns 130, heat is generated simultaneously, and the heat generated by the conductive yarns 130 is transmitted through yarns of the first fabric layer 110*a* and/or yarns of the second fabric layer 120*a*. Specifically, the first fabric layer 110*a* of this embodiment functions as a heat transfer fabric layer, for instance. That is to say, the first fabric layer 110*a* is suitable for rapidly transmitting the heat generated by the conductive yarns 130 to external surroundings whose temperature is lower than the fabric structure 100*a*. The heat transfer directions can be referred to as the direction L1 of the arrow shown in FIG. 1A. Here, the yarn coverage ratio of the first fabric layer 110*a* ranges from about 90% to about 100%, for instance. According to an observation result obtained by an optical microscope, note that the light is projected from the bottom of the fabrics to the top of the fabrics. When the light is blocked or shielded by fibers, no light is observed through the optical microscope. The yarn coverage ratio herein refers to a percentage of fiber coverage within a unit area, and the percentage of fiber coverage is obtained by estimating the area that is covered by the fibers and cannot be projected by the light.

The second fabric layer 120*a* of this embodiment functions as a heat transfer fabric layer as well, for instance. Namely, the second fabric layer 120*a* is suitable for rapidly transmitting the heat generated by the conductive yarns 130 to external surroundings whose temperature is lower than the fabric structure 100*a*. The heat transfer direction can be referred to as the direction L2 of the arrow shown in FIG. 1A. Here, the yarn coverage ratio of the second fabric layer 120*a* ranges from about 90% to about 100%, for instance. Note that the yarn coverage ratio of the first fabric layer 110*a* can be different from or substantially the same as the yarn coverage ratio of the second fabric layer 120*a*, which should not be construed as a limitation to this invention. In brief, the higher the yarn coverage ratios (e.g., 90%-100%) of the first fabric layer 110*a* and the second fabric layer 120*a* are (i.e., the higher the pick count of weaving/knitting is), the easier the heat is transmitted between the first fabric layer 110*a* and the second fabric layer 120*a* of the fabric structure 100*a*, such that the temperature of the first fabric layer 110*a* and the second fabric layer 120*a* rises. As such, the fabric structure 100*a* is capable of performing a heating function on external objects whose temperature is lower than the fabric structure 100*a*. Moreover, the CLO of the fabric structure 100*a* ranges from about 0.1 to about 0.15. Here, CLO refers to a measure of thermal insulation value of clothing, which is adopted in Britain and the United States. Specifically, 1 CLO is defined as the amount of clothing required by a resting person to be comfortable and to have a body's surface temperature at 33° C. at a given set of conditions where the room temperature is 21° C., relative humidity is 50%, and air movement is 10 cm/s. The greater the CLO is, the greater the thermal insulation value is provided. The smaller the CLO is, the smaller the thermal insulation value is provided.

Besides, in this embodiment, the fabric structure 100*a* is integrally knitted. The peak loops 112*a*, 122*a*, 112*b*, 122*b*, 112*c*, and 122*c* are sequentially interlocked by a connecting yarn 140, and the conductive yarns 130 are sandwiched between the first fabric layer 110*a* and the second fabric layer

120*a*. Although only six peak loops 112*a*, 112*b*, 112*c*, 122*a*, 122*b* and 122*c* are enumerated above for illustration, people having ordinary skill in the art can infer the sequence in which the connecting yarns 140 and the other peak loops are interlocked, and thus relevant descriptions of the other peak loops are omitted herein. Through the interlacing method described above, the first fabric layer 110*a*, the second fabric layer 120*a*, and the conductive yarns 130 are closely stacked together, and air existing among the first fabric layer 110*a*, the second fabric layer 120*a*, and the conductive yarns 130 is reduced, so as to enhance the thermal conductivity of the fabric structure 100*a*.

Figure 2:
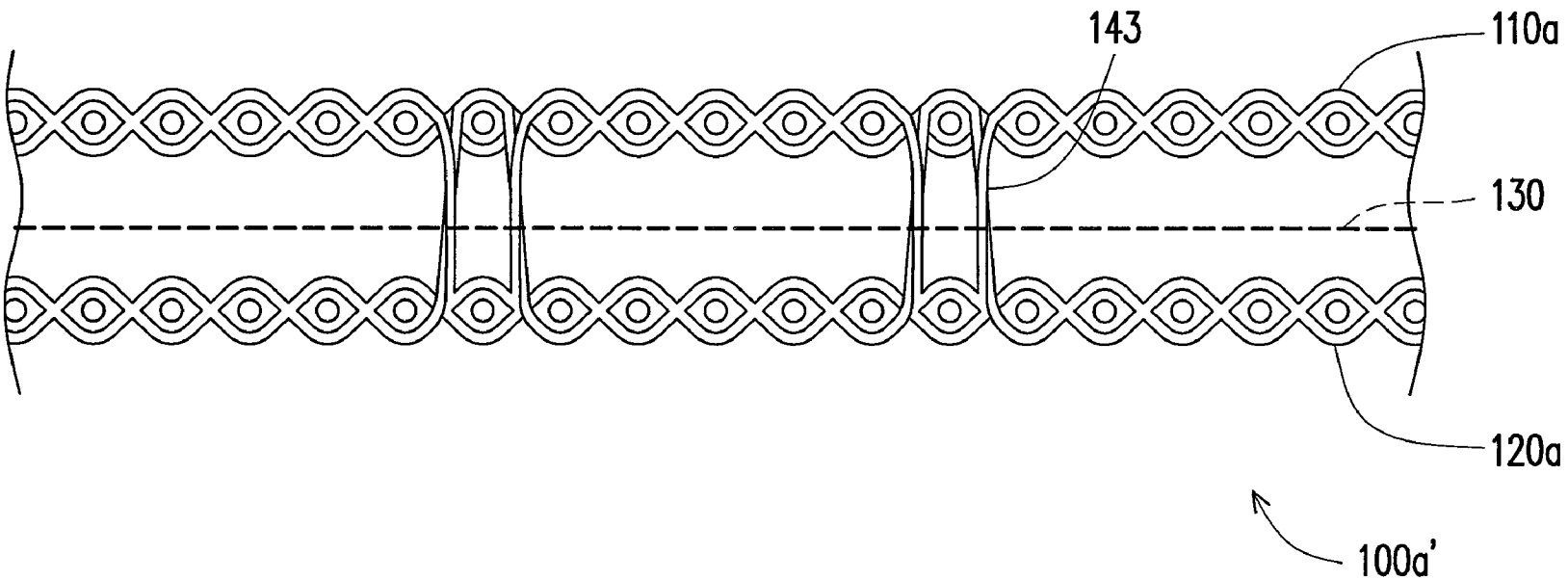
FIG. 2 is a structural view illustrating a fabric structure according to an embodiment of the invention.

Note that the types of the fabric structure 100*a* is not limited in the invention. The fabric structure 100*a* herein is formed by integrally knitting the first fabric layer 110*a*, the second fabric layer 120*a*, and the connecting yarns 140. However, in other embodiments of the invention, as shown in FIG. 2, the fabric structure 100*a*' can also be formed by integrally weaving the first fabric layer 110*a*, the second fabric layer 120*a*, and the connecting yarns 143, which still falls within the technical schemes adopted in the invention without departing from the scope of the invention. That is to say, the fabric structure 100*a* depicted in FIG. 1B is merely exemplary, and the invention is not limited thereto.

Figure 3:
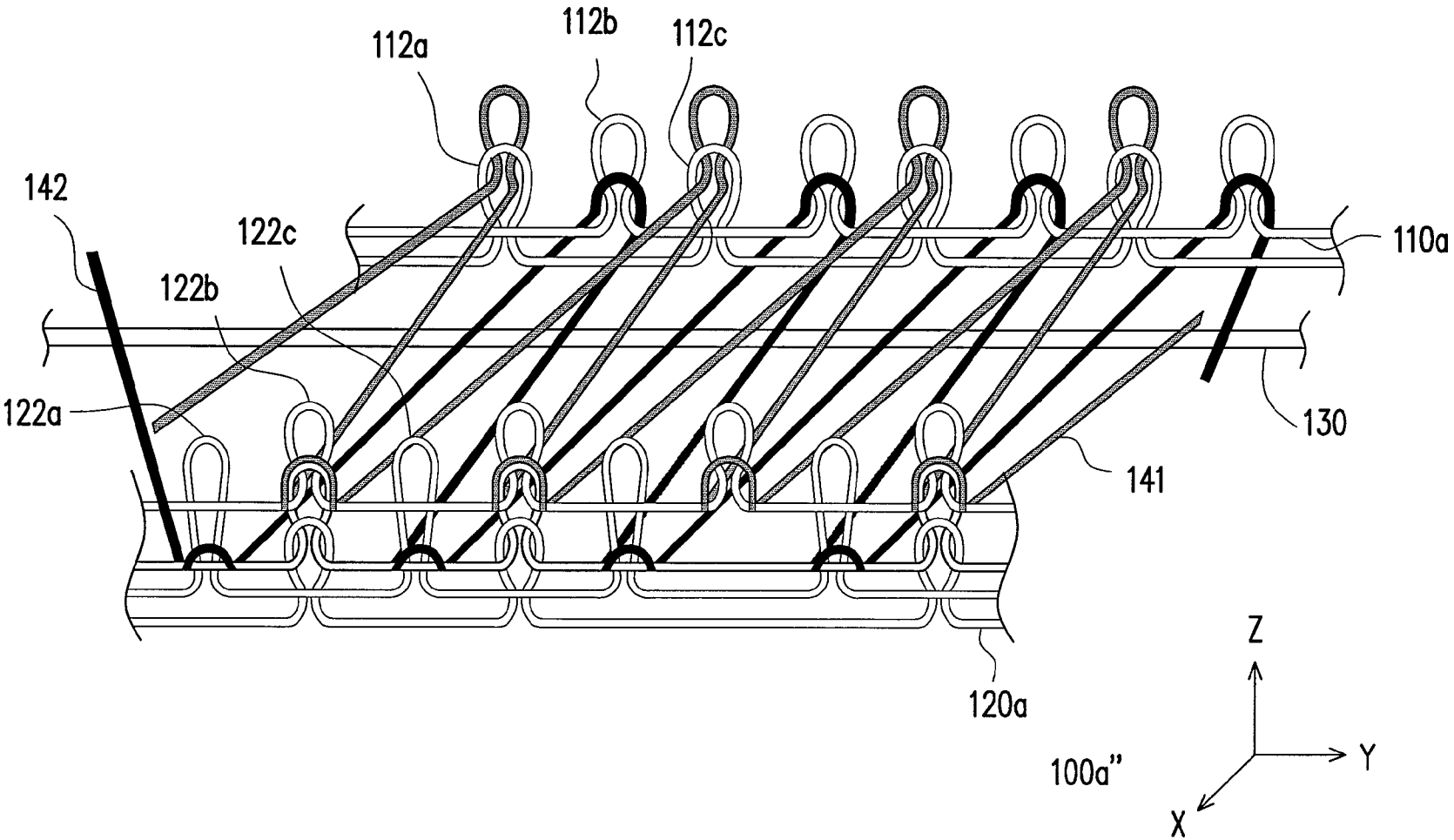
FIG. 3 is a structural view illustrating a fabric structure according to another embodiment of the invention.

FIG. 3 is a structural view illustrating a fabric structure according to an embodiment of the invention. With reference to FIG. 3, the fabric structure 100*a*" depicted in FIG. 3 and the fabric structure 100*a* depicted in FIG. 1B are similar, while the difference there between lies in that the fabric structure 100*a*" depicted in FIG. 3 has two kinds of connecting yarns 141 and 142. In particular, the connecting yarn 141 is interlocked with the peak loops 112*a*, 122*b* and 112*c* of the first fabric layer 110*a* and the second fabric layer 120*a* sequentially, and the connecting yarn 142 is interlocked with the peak loops 122*a*, 112*b* and 122*c* of the first fabric layer 110*a* and the second fabric layer 120*a* sequentially. People having ordinary skill in the art can infer the sequence in which the connecting yarns 141 and 142 and the other peak loops are interlocked, and hence relevant descriptions are not repeated herein.

To sum up, the fabric structures 100*a*, 100*a*', and 100*a*" in these embodiments are made by integrally knitting or weaving the first fabric layer 110*a*, the second fabric layer 120*a*, and the connecting yarns 140. The first fabric layer 110*a*, the second fabric layer 120*a*, and the conductive yarns 130 are closely stacked together by interlacing the connecting yarns 140 and the first and the second fabric layers 110*a* and 120*a*. The conventional fabric structure is formed by stacking the three layers through additionally performing a sewing process or an adhering process. By contrast, this process can be reduced during fabrication of the fabric structures 100*a*, 100*a*', and 100*a*" as described in these embodiments, thus saving the manufacturing time and costs. Moreover, the air existing among the layers is also reduced during the stacking process, so as to enhance the efficiency of thermal conductivity and the uniformity of temperature distribution.

Other fabric structures having the fabric layers with different yarn coverage ratios are exemplified in the following embodiments of the invention.

Figure 4:
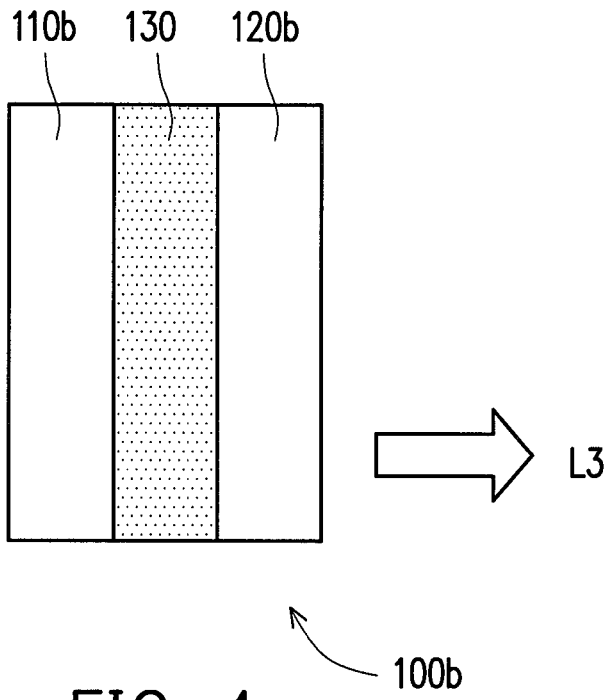
FIG. 4 is a schematic view illustrating a fabric structure according to yet another embodiment of the invention.

FIG. 4 is a schematic view illustrating a fabric structure according to yet another embodiment of the invention. With reference to FIG. 4, the fabric structure 100*b* depicted in FIG. 4 and the fabric structure 100*a* depicted in FIG. 1A are similar, while the difference there between lies in that the yarn coverage ratio of the first fabric layer 110*b* in the fabric structure 100*b* depicted in FIG. 4 is less than 80%, for instance, and the yarn coverage ratio of the second fabric layer 120*b* in the fabric structure 100*b* ranges from about 90% to about 100%, for instance.

In detail, the first fabric layer 110*b* of this embodiment is a heat-insulating fabric layer, for instance. That is to say, the first fabric layer 110*b* is suitable for preventing the heat generated by the conductive yarns 130 from being transmitted to external surroundings, so as to avoid heat loss. The second fabric layer 120*b* is a heat transfer fabric layer, for instance. That is to say, the second fabric layer 120*b* is suitable for rapidly transmitting the heat generated by the conductive yarns 130 to external surroundings. The heat-transmitting direction can be referred to as the direction L3 of the arrow shown in FIG. 4. When an electric current passes through the conductive yarns 130, heat is generated simultaneously, and the heat generated by the conductive yarns 130 is transmitted through yarns of the second fabric layer 120*b*. In other words, the heat generated by the conductive yarns 130 is likely to be transmitted within the fabric layer (i.e., the second fabric layer 120*b*) with high pick count of weaving/knitting (high yarn coverage ratio), and thereby the temperature of the second fabric layer 120*b* rises. As such, the fabric structure 100*b* is capable of performing a heating function on external objects through one side of the fabric structure 100*b*.

Figure 5:
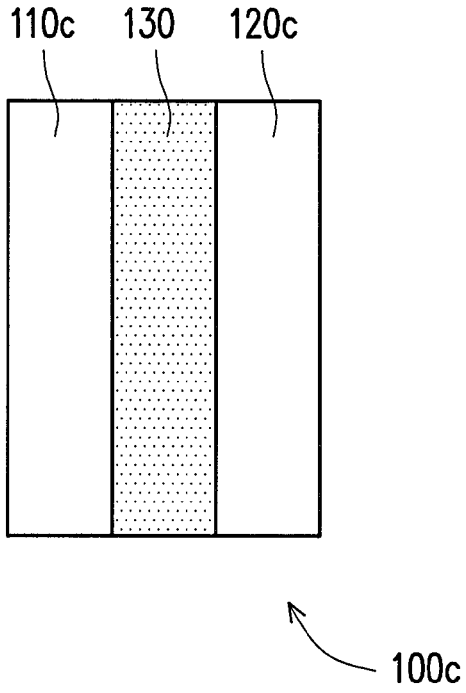
FIG. 5 is a schematic view illustrating a fabric structure according to yet another embodiment of the invention.

FIG. 5 is a schematic view illustrating a fabric structure according to yet another embodiment of the invention. With reference to FIG. 5, the fabric structure 100*c* depicted in FIG. 5 and the fabric structure 100*a* depicted in FIG. 1A are similar, while the difference there between lies in that the yarn coverage ratio of the first fabric layer 110*c* in the fabric structure 100*c* depicted in FIG. 5 is less than 80%, and the yarn coverage ratio of the second fabric layer 120*c* in the fabric structure 100*c* is less than 80%, for instance.

In detail, the first fabric layer 110*c* of this embodiment is a heat-insulating fabric layer. That is to say, the first fabric layer 110*c* is suitable for preventing the heat generated by the conductive yarns 130 from being transmitted to external surroundings, so as to avoid heat loss. The second fabric layer 120*c* of this embodiment is a heat-insulating fabric layer as well, for instance. That is to say, the second fabric layer 120*c* is suitable for preventing the heat generated by the conductive yarns 130 from being transmitted to external surroundings, so as to avoid heat loss. Note that the yarn coverage ratio of the first fabric layer 110*c* can be different from or substantially the same as the yarn coverage ratio of the second fabric layer 120*c*, which should not be construed as a limitation to this invention.

When an electric current passes through the conductive yarns 130, heat is generated simultaneously, and the heat generated by the conductive yarns 130 is not transmitted through yarns of the first fabric layer 110*c* or yarns of the second fabric layer 120*c*. That is to say, the yarns of the first fabric layer 110*c* and the second fabric layer 120*c* respectively form a thermal insulator. Hence, when the temperature of the external substance or air temperature is lower than the temperature of the fabric structure 100*c*, and the external substance or the air is in contact with the fabric structure 100*c*, heat exchange between the substance or the air and the fabric structure 100*c* can be reduced by means of the first fabric layer 110*c* and the second fabric layer 120*c*, such that the fabric structure 100*c* can retain the heat. In addition, the CLO of the fabric structure 100*c* in this embodiment ranges from about 0.15 to about 0.25.

To sum up, the higher the yarn coverage ratios of the fabric layers (e.g., the first and the second fabric layers 110*a* and 120*a* or the second fabric layer 120*a* alone) are (i.e., the higher the pick count of weaving/knitting is), the easier the heat is transmitted within the fabric layers of the fabric structure, such that the temperature of the fabric layers rises. As such, the fabric structure (e.g., the fabric structures 100*a*, 100*a*', 100*a*", and 100*b*) can achieve the heating function. From another perspective, the lower the yarn coverage ratios of the fabric layers (e.g., the first and the second fabric layers 110*a* and 120*a*) are (i.e., the lower the pick count of weaving/knitting is), the more the air exists within the fabric layers of the fabric structure. Since the thermal conductivity of the air is smaller than that of the yarns of the fabric layers, the air impedes heat transmission within the fabric layers of the fabric structure. Accordingly, the temperature of the fabric layers is not apt to rise, and the fabric structure (e.g., the fabric structure 100*c*) can achieve the heat-retaining function.

EXPERIMENTAL EXAMPLE

Figure 6A:
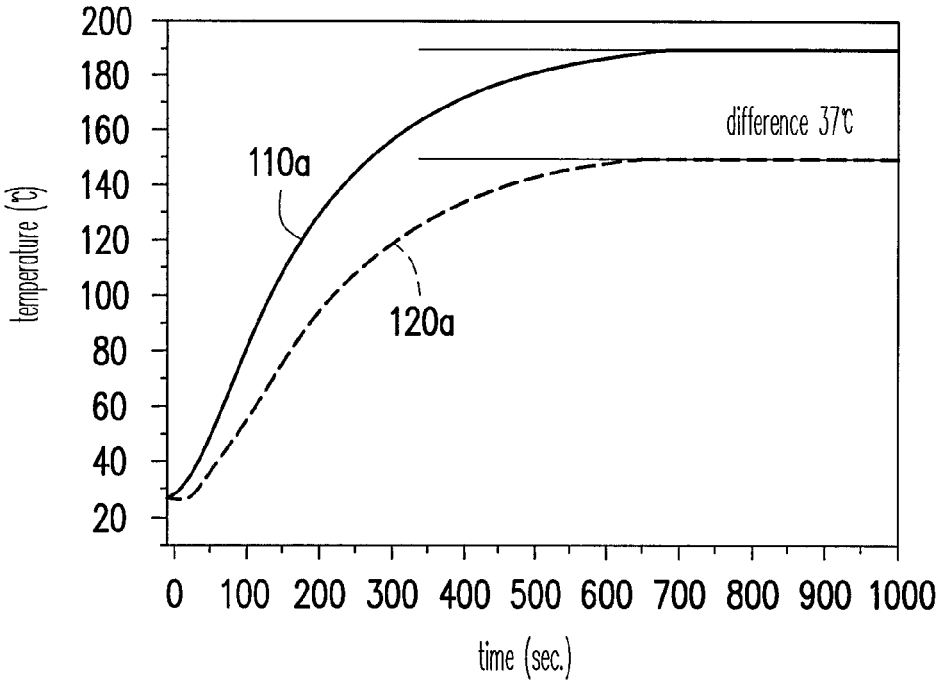
FIG. 6A to FIG. 6C illustrate the correlation between time and temperature of the fabric structures depicted in FIG. 1A, FIG. 4, and FIG. 5 when the fabric structures have different yarn coverage ratios.
Figure 6B:
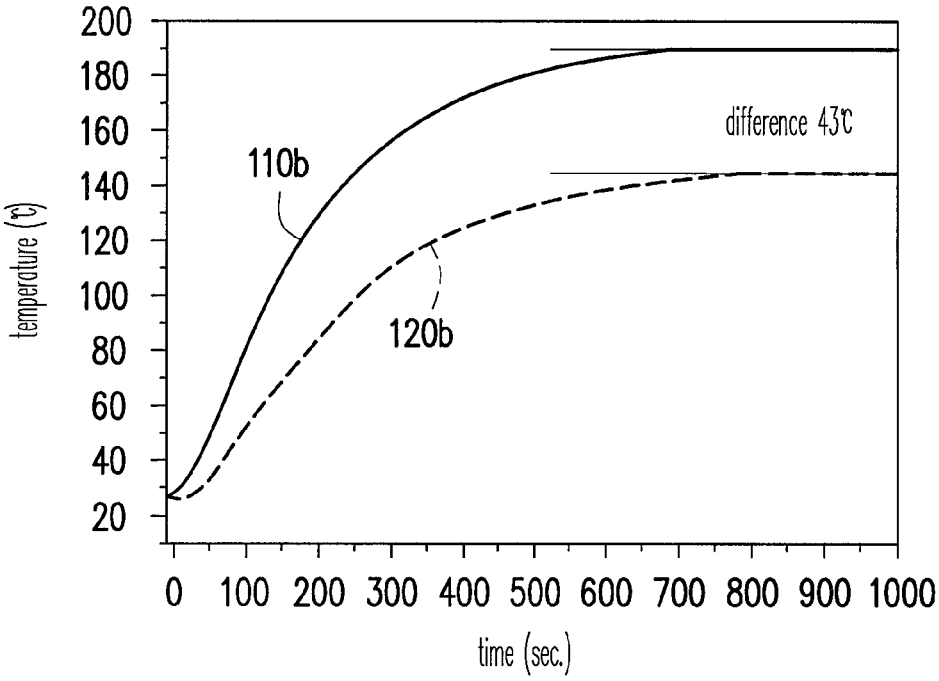
Figure 6C:
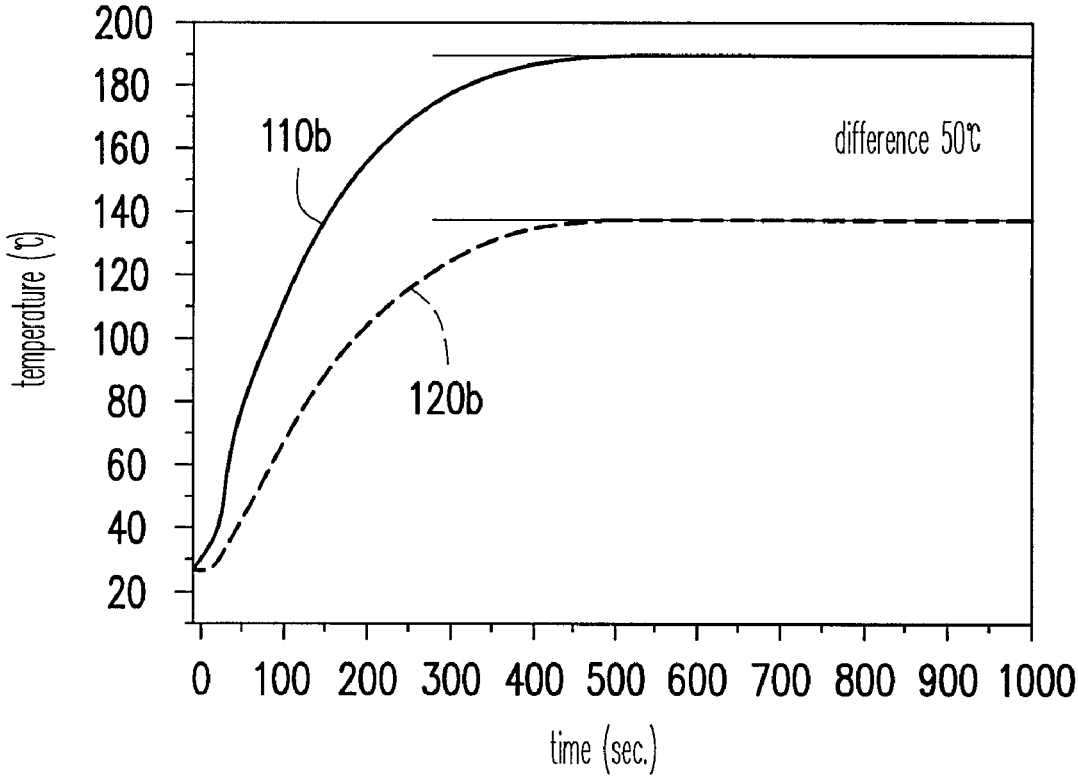

FIG. 6A to FIG. 6C illustrate the correlation between time and temperature of the fabric structures depicted in FIG. 1A, FIG. 4, and FIG. 5 when the fabric structures have different yarn coverage ratios. With reference to FIG. 6A to FIG. 6C, in this embodiment, Kevlar serves as the testing fiber for performing the weaving process. Longitudinal pick count and latitudinal pick count of Kevlar as shown in FIG. 6A are 12 ends per inch and 12 ends per inch, respectively. Longitudinal pick count and latitudinal pick count of Kevlar as shown in FIG. 6B are 12 ends per inch and 6 ends per inch, respectively. Longitudinal pick count and latitudinal pick count of Kevlar as shown in FIG. 6C are 6 ends per inch and 6 ends per inch, respectively.

As shown in FIG. 6A to FIG. 6C, when the pick count of the fabric layers is high, e.g., 12 ends per inch (longitudinal pick count)*12 ends per inch (latitudinal pick count), the difference between the temperature of the first fabric layer 110*a* and the temperature of the second fabric layer 120*a* is 37° C. When the pick count of the fabric layers is reduced to half, e.g., 6 ends per inch (longitudinal pick count)*6 ends per inch (latitudinal pick count), the difference between the temperature of the first fabric layer 110*a* and the temperature of the second fabric layer 120*a* is increased to 50° C. When the pick count of the fabric layers is partially reduced to half, e.g., 12 ends per inch (longitudinal pick count)*6 ends per inch (latitudinal pick count), the difference between the temperature of the first fabric layer 110*a* and the temperature of the second fabric layer 120*a* is 43° C. Here, when the difference between the temperature of the first fabric layers 110*a*, 110*b*, and 110*c* and the temperature of the second fabric layers 120*a*, 120*b*, and 120*c* is reduced, it means the heat is rapidly transmitted, such that the temperature of the first fabric layers 110*a*, 110*b*, and 110*c* approximates to the temperature of the second fabric layers 120*a*, 120*b*, and 120*c*. By contrast, given the heat is not transmitted but retained within the fabric structure, the difference between the temperature of the first fabric layers 110*a*, 110*b*, and 110*c* and the temperature of the second fabric layers 120*a*, 120*b*, and 120*c* is gradually increased. Said experimental results correspond to the CLO of the fabric structures 100*a*, 100*b*, and 100*c*. Namely, the smaller the CLO is, the lower the thermal resistance is. As such, the heat of the fabric structure is apt to be dissipated, and the fabric structure has unfavorable thermal insulation. On the contrary, the greater the CLO is, the greater the thermal resistance is, and the fabric structure is apt to retain the heat.

In light of the foregoing, the fabric structure of the invention is made by integrally knitting or weaving the first fabric layer, the second fabric layer, and the connecting yarns. The first fabric layer, the second fabric layer, and the conductive yarns are closely stacked together by interlacing the connecting yarns and the first and the second fabric layers. The conventional fabric structure is formed by stacking the three layers through additionally performing a sewing process or an adhering process. By contrast, this process can be reduced during fabrication of the fabric structure of the invention, thus saving the manufacturing time and costs. Moreover, the air existing among the layers is also reduced during the stacking process, so as to enhance the efficiency of thermal conductivity and the uniformity of temperature distribution. Further, the fabric structure of the invention is capable of performing a heating function or a heat-retaining function by changing the yarn coverage ratio of the first fabric layer and the yarn coverage ratio of the second fabric layer. As such, applicability of the invention can be extended.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A fabric structure comprising:

a first fabric layer, a yarn coverage ratio of the first fabric layer ranging from about 90% to about 100%;

a second fabric layer, a yarn coverage ratio of the second fabric layer ranging from about 90% to about 100%;

a plurality of conductive yarns distributed between the first fabric layer and the second fabric layer, wherein the conductive yarns are not interwoven with the first fabric layer and the second fabric layer; and a plurality of connecting yarns interlacing the first fabric layer and the second fabric layer, such that the conductive yarns are sandwiched between the first fabric layer and the second fabric layer, wherein the conductive yarns and the connecting yarns are not interwoven.

2. The fabric structure as claimed in claim 1, wherein a total thickness of the first fabric layer, the second fabric layer, and the connecting yarns ranges from about 3 millimeters to about 20 millimeters.

3. The fabric structure as claimed in claim 1, wherein a characteristic thermal insulation value (CLO) of the fabric structure ranges from about 0.1 to about 0.15.

4. The fabric structure as claimed in claim 1, wherein the first fabric layer and the second fabric layer are heat transfer fabric layers.

5. The fabric structure as claimed in claim 1, wherein the yarn coverage ratio of the first fabric layer is different from the yarn coverage ratio of the second fabric layer.

6. The fabric structure as claimed in claim 1, wherein the yarn coverage ratio of the first fabric layer is substantially the same as the yarn coverage ratio of the second fabric layer.

7. The fabric structure as claimed in claim 1, wherein the first fabric layer, the second fabric layer, and the connecting yarns are integrally woven or knitted.

8. A fabric structure comprising:

a first fabric layer, a yarn coverage ratio of the first fabric layer being less than 80%;

a second fabric layer, a yarn coverage ratio of the second fabric layer ranging from about 90% to about 100%;

a plurality of conductive yarns distributed between the first fabric layer and the second fabric layer, wherein the conductive yarns are not interwoven with the first fabric layer and the second fabric layer; and a plurality of connecting yarns interlacing the first fabric layer and the second fabric layer, such that the conductive yarns are sandwiched between the first fabric layer and the second fabric layer, wherein the conductive yarns and the connecting yarns are not interwoven.

9. The fabric structure as claimed in claim 8, wherein a total thickness of the first fabric layer, the second fabric layer, and the connecting yarns ranges from about 3 millimeters to about 20 millimeters.

10. The fabric structure as claimed in claim 8, wherein a characteristic thermal insulation value (CLO) of the fabric structure ranges from about 0.1 to about 0.15.

11. The fabric structure as claimed in claim 8, wherein the first fabric layer is a heat-insulating fabric layer, and the second fabric layer is a heat transfer fabric layer.

12. The fabric structure as claimed in claim 8, wherein the first fabric layer, the second fabric layer, and the connecting yarns are integrally woven or knitted.

13. A fabric structure comprising:

a first fabric layer, a yarn coverage ratio of the first fabric layer being less than 80%;

a second fabric layer, a yarn coverage ratio of the second fabric layer being less than 80%;

a plurality of conductive yarns distributed between the first fabric layer and the second fabric layer, wherein the conductive yarns are not interwoven with the first fabric layer and the second fabric layer; and a plurality of connecting yarns interlacing the first fabric layer and the second fabric layer, such that the conductive yarns are sandwiched between the first fabric layer and the second fabric layer, wherein the conductive yarns and the connecting yarns are not interwoven.

14. The fabric structure as claimed in claim 13, wherein a total thickness of the first fabric layer, the second fabric layer, and the connecting yarns ranges from about 3 millimeters to about 20 millimeters.

15. The fabric structure as claimed in claim 13, wherein a characteristic thermal insulation value (CLO) of the fabric structure ranges from about 0.15 to about 0.25.

16. The fabric structure as claimed in claim 13, wherein the first fabric layer and the second fabric layer are heat-insulating fabric layers.

17. The fabric structure as claimed in claim 13, wherein the yarn coverage ratio of the first fabric layer is different from the yarn coverage ratio of the second fabric layer.

18. The fabric structure as claimed in claim 13, wherein the yarn coverage ratio of the first fabric layer is substantially the same as the yarn coverage ratio of the second fabric layer.

19. The fabric structure as claimed in claim 13, wherein the first fabric layer, the second fabric layer, and the connecting yarns are integrally woven or knitted.

* * * * *